US005463942A

United States Patent [19]

Hupf et al.

[11] Patent Number: 5,463,942

[45] Date of Patent: Nov. 7, 1995

[54] MOTORIZED TOOL FOR SLICING AND TENDERIZING FOODS AND METHOD

[75] Inventors: Charles J. Hupf, Cascade; Jeffrey Rohrer, Kewaskum, both of Wis.

[73] Assignee: Regal Ware, Inc., Kewaskum, Wis.

[21] Appl. No.: 193,311

[22] Filed: Feb. 8, 1994

[51] Int. Cl.[6] ..... B26B 7/00

[52] U.S. Cl. ..... 99/537; 99/588; 30/276; 30/277.4

[58] Field of Search ..... 99/541, 543, 545, 99/576, 588, 593, 538, 537; 30/272.1, 273, 274, 275.4, 276, 277.4; 310/319, 307

[56] References Cited

U.S. PATENT DOCUMENTS

| | | | |
|---|---|---|---|
| D. 297,390 | 8/1988 | Fehrmann | D7/102 |
| 1,928,718 | 10/1933 | Covey . | |
| 1,942,766 | 1/1934 | O'Banion | 30/276 |
| 2,945,298 | 7/1960 | Guttmann | 30/277.4 |
| 2,958,355 | 11/1960 | Young . | |
| 3,115,171 | 12/1963 | Loveland | 99/593 |
| 3,664,021 | 5/1972 | Sawyer | 30/277.4 |
| 3,710,445 | 1/1973 | Roth | 30/241 |
| 4,295,272 | 10/1981 | Kubota | 30/276 |
| 4,534,858 | 8/1985 | Aldrich et al. | 30/122 |
| 4,674,154 | 6/1987 | Gilbert et al. . | |
| 4,776,092 | 10/1988 | Moores et al. | 30/277.4 |
| 4,972,769 | 11/1990 | Cailliot | 99/541 |

FOREIGN PATENT DOCUMENTS

| | | | |
|---|---|---|---|
| 0611489 | 3/1935 | Germany | 30/272.1 |
| 0573580 | 2/1958 | Italy | 30/272.1 |

*Primary Examiner*—David Scherbel
*Assistant Examiner*—Reginald L. Alexander
*Attorney, Agent, or Firm*—Wheeler & Kromholz

[57] ABSTRACT

A motorized tool for slicing food having a motor, a cutting tool, a shaft, and a connector connecting the shaft to the motor. The cutting tool mounted to the shaft. Alternatively, the invention can be converted into a motorized tool for tenderizing meats having a motor, a meat tenderizer, and a connector connecting the meat tenderizer to the motor. A method for cutting food using a motorized tool for slicing food described herein. The method comprising actuating the motor, applying the cutting edge to the food, applying sufficient pressure to begin to cut the food, and moving the cutting edge across the food so that the food is cut. Alternatively, when using the meat tenderizer disclosed herein the method may be simply described as comprising the steps of actuating the motor, applying the tenderizing surface to the meat, and moving the tenderizing surface whereby the meat is tenderized.

6 Claims, 6 Drawing Sheets

MOTORIZED TOOL FOR SLICING AND TENDERIZING FOODS AND METHOD

BACKGROUND OF THE INVENTION

The present invention relates generally to the field of cutting and tenderizing foods and specifically to the field of tools for cutting pizza and the like and tenderizing meats, e.g., beef, poultry, venison, etc.

While there are many devices that are known for cutting pizza or tenderizing meats the device of this invention is directed toward a unique and simple design and method for quickly and easily cutting pizza or tenderizing meat.

Essentially, the present invention is directed at a motorized tool for cutting pizza or tenderizing meat. While other motorized tools are known, e.g., the electric knife, the inventor knows of no other prior art that teaches the present invention.

For example, in an electric knife movement is imparted to the cutting blade directly by the motor so that the cutting edge of the knife is constantly undergoing a reciprocal motion. The present invention operates in a different manner. The cutting blade or tenderizer, typically a disc, is freely mounted to a shaft so that the disc does not spin or rotate on the shaft due to the action of the motor. Rather, the motor moves the shaft in a reciprocal manner but the disc rotates in the normal manner of a pizza cutter when the user slices the pizza.

In this manner the user is greatly assisted in cutting but has control over the length and direction of the cut. If the disc were allowed to rotate or spin by means of the motor then the device of the present invention would function like a motorized wheel and ride away from the user's hand during operation.

Alternatively, this problem could also be addressed with a fixed blade that takes advantage of the impacting action of the present invention. The important point would be to prevent any mechanically driven rotary motion from being imparted to the cutting tool.

Accordingly, it is a goal of the present invention to produce a motorized tool for cutting pizza and tenderizing meats in which the user is able to control the cutting or tenderizing process while being assisted by the mechanical device.

It is a further goal of the present invention to provide, at least in the alternative, the ability to use the present invention as an attachment to an electric knife while maintaining the advantages of the present invention.

It is a further goal of the present invention to be designed so that rotary motion is not mechanically imparted to the cutting tool by any motorized source.

SUMMARY OF THE INVENTION

The present invention is a motorized tool for slicing food. The tool may be generally described as a device having a motor, a cutting tool (e.g. a cutting disc or cutting blade), a shaft, and a connector connecting the shaft to the motor. The cutting tool is preferably freely mounted to the shaft, however, this is not absolutely necessary. Accordingly, no mechanized rotary movement is directly imparted to the cutting disc. Instead an impact motion is applied so that while the user pushes the tool across the food, e.g. pizza, the cutting edge of the tool is being pushed and pulled so that the cutting edge presses against the food and the food is cut while the user is able to easily control the movement of the cutting tool.

Alternatively, with some modification the present invention can be converted into a motorized tool for tenderizing meats. In this form the tool generally includes a motor, a meat tenderizer, and a connector connecting the meat tenderizer to the motor. The meat tenderizer may either be integral to the connector, for example a connecting rod or strap, or it may be connected to the motor by a fastener. Further, if the tenderizer is a of a rotary design then the tenderizer will be freely mounted to a shaft. However, if the tenderizer is not of a rotary design but is instead composed of block having tenderizing elements then it will not necessarily be freely mounted to the shaft.

Additionally, the present invention may be characterized as a method for cutting food using a motorized tool for slicing food described herein. The method simply comprises the steps of actuating the motor, applying the cutting edge to the food, applying sufficient pressure to begin to cut the food, and moving the cutting edge across the food so that the food is cut.

Alternatively, when using the meat tenderizer disclosed herein the method may be simply described as comprising the steps of actuating the motor, applying the tenderizing surface to the meat, and moving the tenderizing surface whereby the meat is tenderized.

These and other benefits of the present invention will be apparent to one skilled in the art from the following description.

DETAILED DESCRIPTION

Although the disclosure hereof is detailed and exact to enable those skilled in the art to practice the invention, the physical embodiments herein disclosed merely exemplify the invention which may be embodied in other specific structure. While the preferred embodiment has been described, the details may be changed without departing from the invention, which is defined by the claims.

The invention 10 is a device for cutting pizza and tenderizing meats. However, other foods, e.g. breads, may also be cut with the present invention or by the method disclosed and claimed herein.

Figure 1:
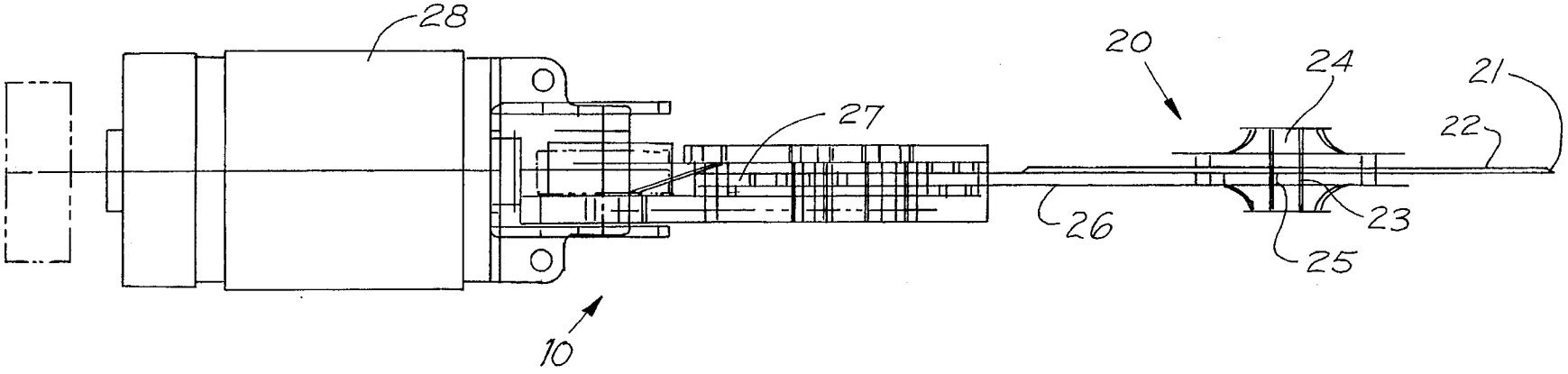
FIG. 1 is a bottom plan view of the present invention.

Referring to FIG. 1, the food slicer 20 of the present invention 10 may be seen to be composed of a rotary cutting disc 22, a shaft 24, a connecting rod 26 having ends 25 and 27, and an electric motor 28. The electric motor 28 may be of any type that is capable of producing either a reciprocal or oscillatory motion; e.g. the device in a vibrating motor. In the present invention the electric motor 28 that is used is the same type as found in a conventional electric knife and imparts a reciprocating linear motion to the end 27 of the connecting rod 26 that is attached to the motor 28.

The cutting disc 22 has a cutting edge 21 that is used for cutting the food, e.g. pizza. The cutting disc 22 is freely mounted to the shaft 24. End or portion 25 of the connecting rod 26 is attached to at least one end 23 of the shaft 24.

Figure 2:
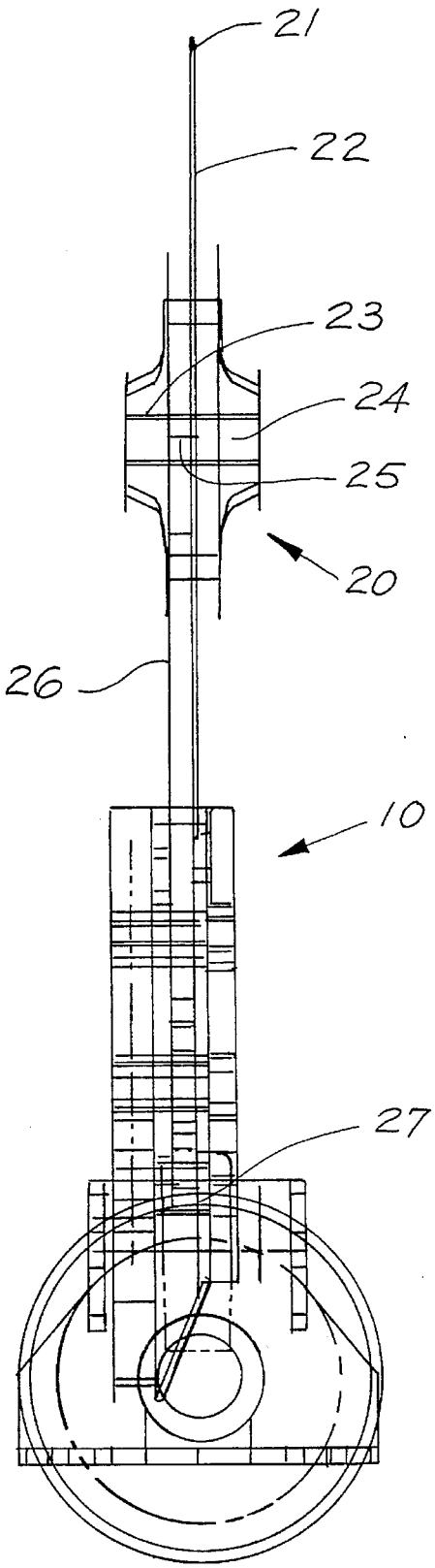
FIG. 2 is a head on plan view of the present invention showing an alternative mode of the present invention in which the connector that connects the cutting disc to the motor is at approximately a 45° angle. This embodiment is presently believed to be the most commercially viable.
Figure 3:
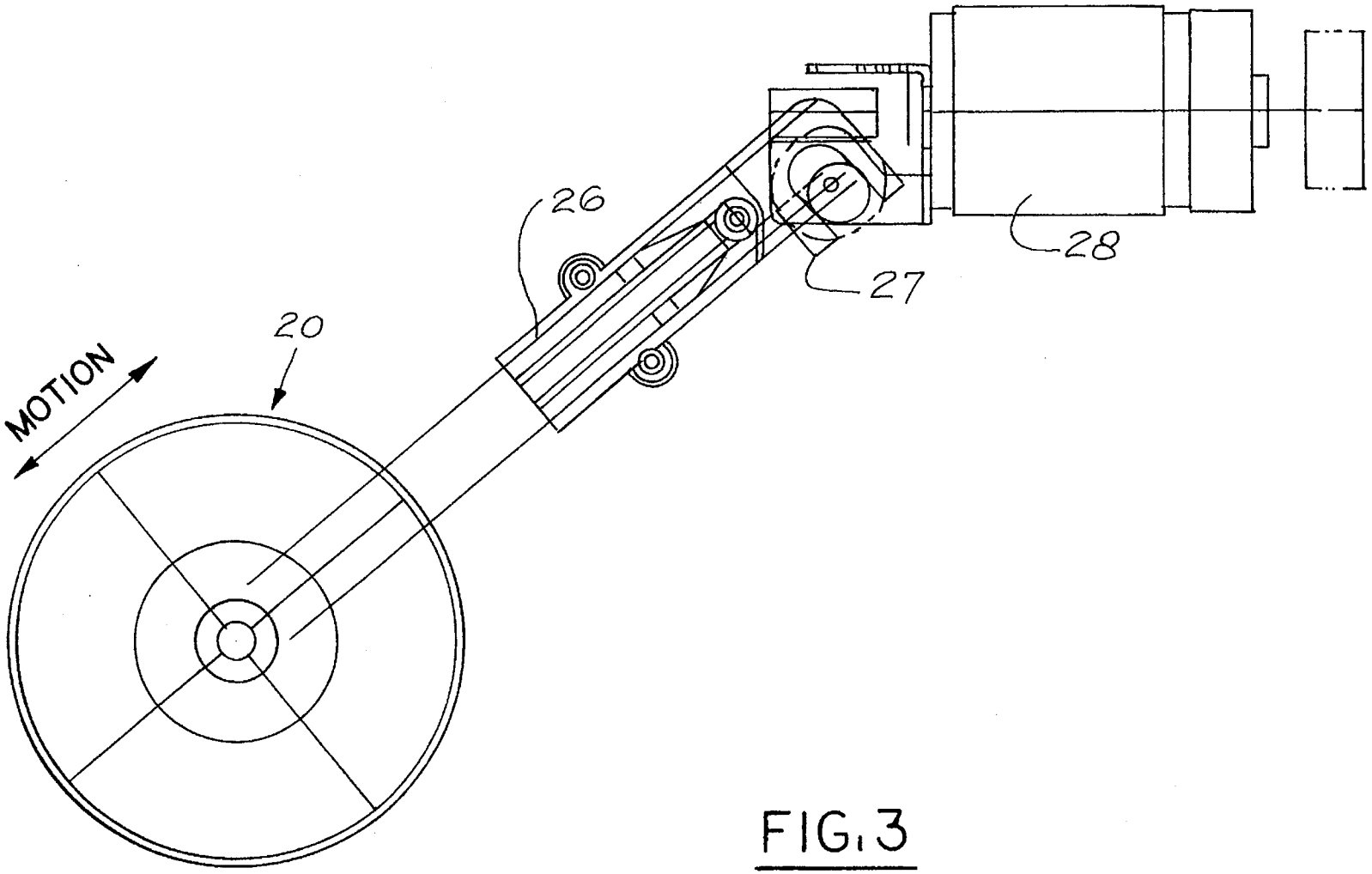
FIG. 3 is a schematic side view of the invention shown in FIG. 2.
Figure 4:
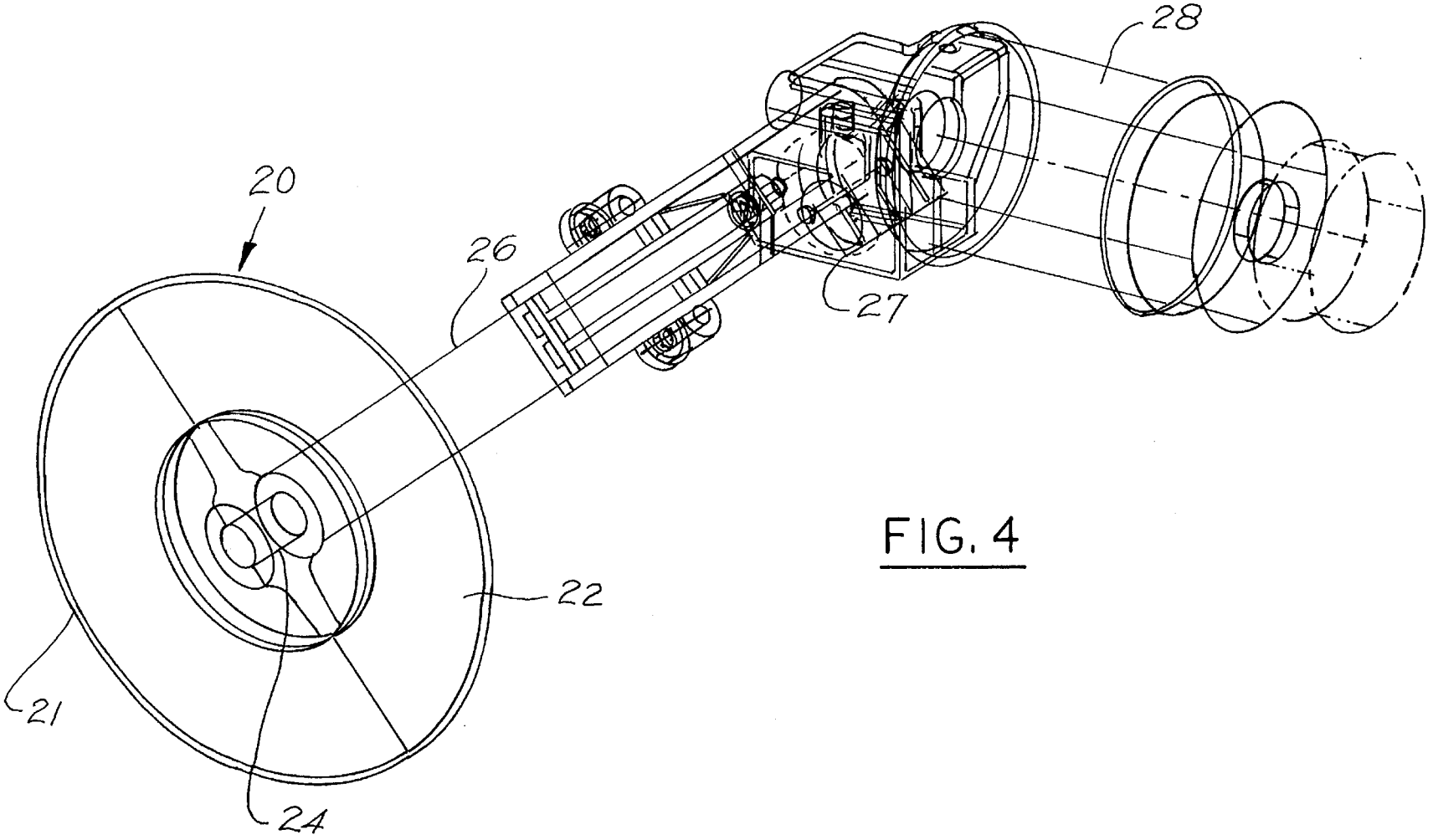
FIG. 4 is a perspective plan view showing the alternative embodiment of FIG. 3.

Referring to FIGS. 2, 3, and 4, an alternative embodiment of the present invention 10 is shown. In this embodiment the food slicer 20 is attached at a 45° angle to the electric motor 28 by connecting rod 26. This imparts a downward motion as well as a back and forth motion thereby making foods, like pizza or bread, much easier to cut.

Figure 5A:
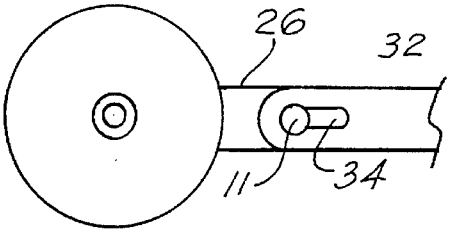
FIG. 5*a* is a schematic view of the cutting assembly of the present invention showing a connector for connecting to an electric knife at a 180° angle.
Figure 5:
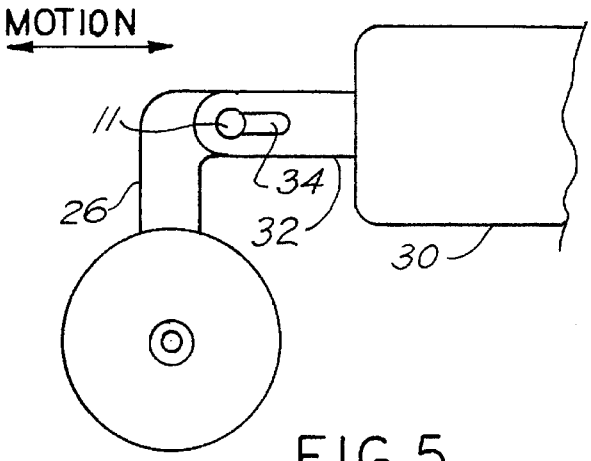
FIG. 5 is a schematic view showing the present invention connected to an electric knife at a 90° angle.
Figure 6A:
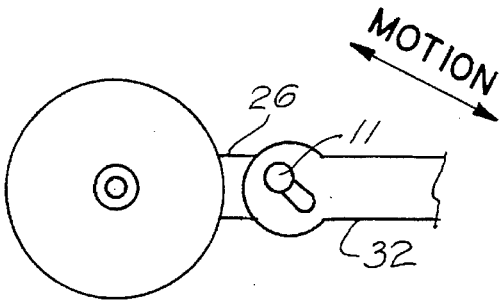
FIG. 6*a* is a schematic view of an alternative embodiment of the device disclosed in FIG. 5*a* showing the fastener to be in a slot that is approximately at an angle of 45° to the connector.
Figure 6:
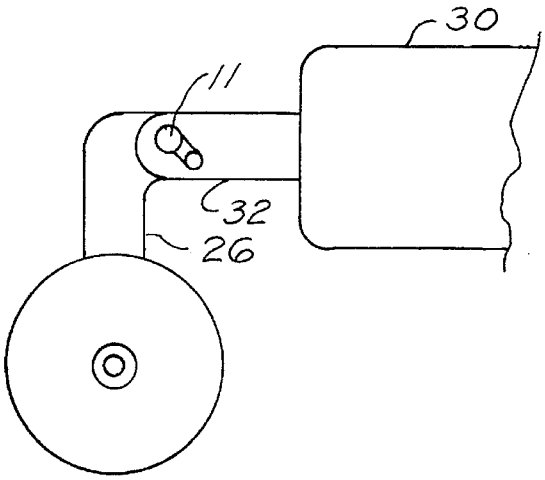
FIG. 6 is a schematic view of an alternative embodiment of the present invention disclosed in FIG. 5 showing the fastener to be in a slot that is approximately at an angle of 45° to the connector.
Figure 7:
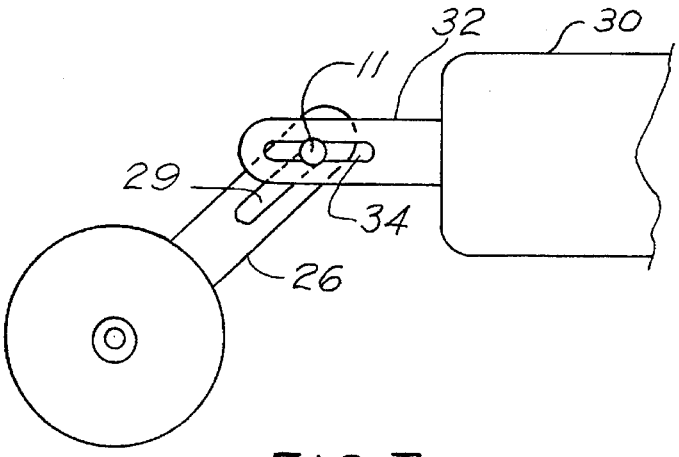
FIG. 7 is a schematic view of another alternative embodiment of the present invention showing the present invention connected to an electric knife at a 45° angle and the slots on the connector to the electric knife and the food slicer being at a 45° to each other.

Referring to FIGS. 5–7, the present invention 10 is shown connected in various ways to an electric knife handle 30 having an electric motor 28 (not shown in these Figures). In electric knives the knives are typically mounted to two drive rods 32. The drive rods are connected to the reciprocating electric motor 28 so that they have a reciprocating linear motion out of phase with each other. Further, each of the drive rods 32 have 34 slots that are parallel to each other.

In the present invention this typically means that the connecting rod 26 will be equipped with a slot 29. Slot 29 and slots 34 will be orientated so that they cross each other at the desired angle, e.g. 45 degrees, however, any angle between 90 degrees and 0 degrees could be used. A stud or screw 11 is passed through the slot 29 and slots 34, preferably at the midpoint of the slots 34. The screw 11 is tightened so that rod 26 is held in place against one of the rods 32 but not both rods 32.

Accordingly, rod 26 will not have out of phase movement imparted to it but will be moved back in forth in the manner previously described herein.

Figure 8:
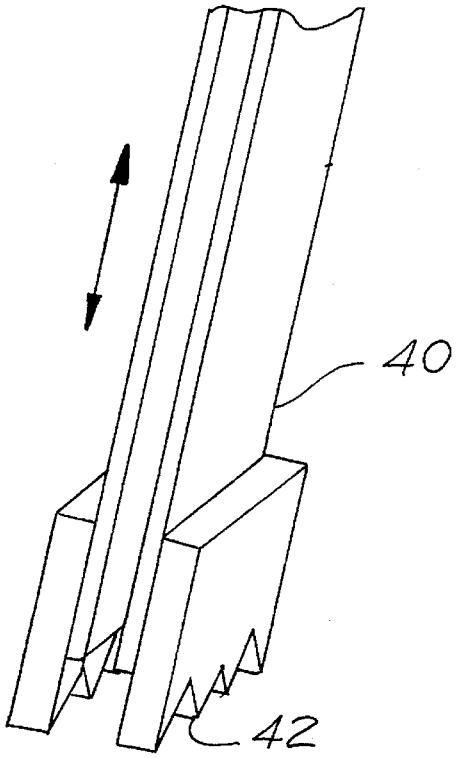
FIG. 8 is a perspective view showing a meat tenderizer capable of being used in conjunction with the present invention.
Figure 9:
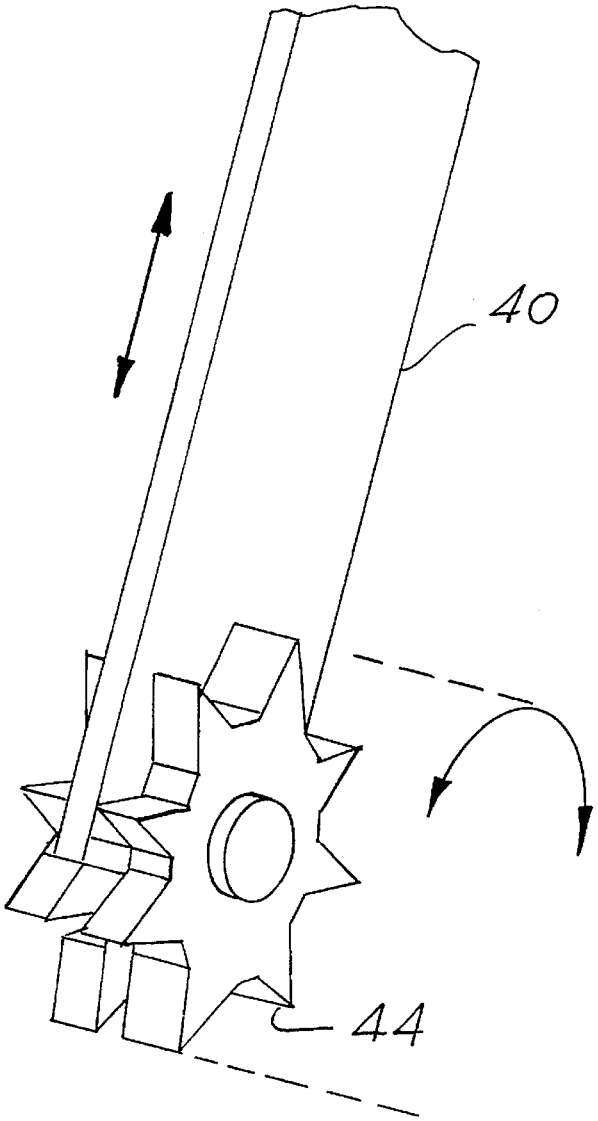
FIG. 9 is a perspective view of an alternative embodiment of a meat tenderizer for use in conjunction with the present invention.

Referring now to FIGS. 8 and 9, the food slicer 20 of the present invention my be replaced with a meat tenderizer 40 having tenderizing surfaces 42 and 44. All connections to the electric motor 28 are as previously described. Meat tenderizing surface 42 is integral to the connecting rod 26. However, meat tenderizer 44 is freely mounted to a shaft 46 so that the operational relationship between tenderizer 44 and shaft 46 is the same as the operational relationship between the cutting disc 22 and the shaft 24.

Any design of meat tenderizer 40 capable of mechanically tenderizing the meat may be used.

The food slicer 20 of the present invention 10 may be used by actuating the motor 28 and applying the cutting edge 21 to the pizza with sufficient pressure to begin to cut the pizza so that moving the cutting edge 21 across the pizza cuts it.

The tenderizer 40 may be used on the present invention 10 by actuating the motor and applying a tenderizing surface to the meat, and moving the tenderizing surface whereby the meat is tenderized.

Alternatively, the present invention 10 could be modified so that the disc 22 is fixed to the shaft 24 to take advantage of the impacting force of the motor. However, while this would practice the present invention 10 it would make it more difficult to move the food slicer 20 across the food that is to be sliced because you would have a sliding movement rather than a rolling movement. Consequently, there would be more resistance to the.cutting process and there would be a tendency to push or pull the food being cut.

The foregoing is considered as illustrative only of the principles of the invention. Furthermore, since numerous modifications and changes will readily occur to those skilled in the art, it is not desired to limit the invention to the exact construction and operation shown and described.

What is claimed is:

1. A motorized tool for slicing food, the tool comprising:

a housing;

a motor;

a cutting disc;

a shaft;

the motor located and fixedly attached within the housing;

a connector having two ends, the first end removably coupled to the motor within the housing;

the second end connected to the shaft;

the connector capable of holding the shaft at any predetermined angle between 0 and 90 degrees with respect to the motor;

the cutting disc being fixedly mounted to the shaft.

2. The motorized tool of claim 1 wherein the cutting disc has a cutting edge.

3. The motorized tool of claim 1 wherein the cutting disc is mounted to the shaft in a non-driven rotatable state.

4. The motorized tool of claim 1 wherein the motor is a reciprocating motor.

5. The motorized tool of claim 1 wherein the motor is an oscillating motor.

6. A motorized tool for slicing food, the motorized tool comprising:

a motor;

a shaft;

a connector;

a cutting disc;

the connector coupling the motor to the shaft at an angle between 0 and 90 degrees with respect to the motor;

the cutting disc having a cutting edge and being mounted to the shaft in a non-driven rotatable state;

the cutting disc capable of moving across the food;

a portion of the cutting edge always being in direct cutting contact with the food;

the motor providing a cutting impact through the connector and shaft to the cutting edge.

* * * * *